US011813728B2

(12) United States Patent
Williams-Sterling

(10) Patent No.: US 11,813,728 B2
(45) Date of Patent: Nov. 14, 2023

(54) MULTI-FUNCTION NAIL TOOL

(71) Applicant: Sterling Hair Solutions, Long Beach, CA (US)

(72) Inventor: Jody Abram Williams-Sterling, Long Beach, CA (US)

(73) Assignee: Sterling Hair Solutions, Long Beach, CA (US)

( * ) Notice: Subject to any disclaimer, the term of this patent is extended or adjusted under 35 U.S.C. 154(b) by 3 days.

(21) Appl. No.: 17/357,601

(22) Filed: Jun. 24, 2021

(65) Prior Publication Data

US 2022/0001524 A1 Jan. 6, 2022

Related U.S. Application Data

(60) Provisional application No. 63/047,101, filed on Jul. 1, 2020.

(51) Int. Cl.

| | |
|---|---|
| ***B25F 1/00*** | (2006.01) |
| ***A45D 29/04*** | (2006.01) |
| ***A44B 15/00*** | (2006.01) |
| ***B25B 7/00*** | (2006.01) |
| ***B67B 7/16*** | (2006.01) |

(52) U.S. Cl.

CPC ..... *B25F 1/003* (2013.01); *A44B 15/00* (2013.01); *A45D 29/04* (2013.01); *B25B 7/00* (2013.01); *B67B 7/16* (2013.01)

(58) Field of Classification Search

CPC ..... B25F 1/003; A44B 15/00; A45D 29/04; B25B 7/00; B25B 7/22; B25B 7/08; B67B 7/16

USPC ..... 7/162, 113, 151, 125; 81/355, 294, 99, 81/992

See application file for complete search history.

(56) References Cited

U.S. PATENT DOCUMENTS

| | | | | |
|---|---|---|---|---|
| 4,949,600 | A * | 8/1990 | Tricinella | B67B 7/44 81/3.55 |
| 6,951,040 | B2 * | 10/2005 | Muller | A45D 29/02 7/162 |
| 7,144,128 | B2 * | 12/2006 | Brauner | A01K 97/00 362/120 |
| 8,166,850 | B2 * | 5/2012 | Caniparoli | B25G 1/085 7/137 |
| 9,256,302 | B2 * | 2/2016 | Chang | B43K 29/00 |
| 9,307,898 | B2 * | 4/2016 | Stout | A61B 5/1072 |

(Continued)

FOREIGN PATENT DOCUMENTS

KR 0126397 Y1 * 9/1998

OTHER PUBLICATIONS

Keychain Bottle Opener. Bar Buddyz (Jan. 15, 2016) [retrieved on Feb. 21, 2023]. Retrieved from the Internet: <URL: https://www.amazon.com/Keychain-Bottle-Opener-bartender-Versatile/dp/B01ANYSBGM?th=1>. (Year: 2016).*

*Primary Examiner* — Eric J Rosen
*Assistant Examiner* — Christopher Soto
(74) *Attorney, Agent, or Firm* — Perkins Coie LLP; Colin Fowler

(57) ABSTRACT

The present embodiments relate to a multi-function nail tool. The nail tool can include multiple extension arms that can allow for gripping and manipulating objects, particularly for individuals that have accessories on their hands or need additional assistance with manipulating objects. The nail tool can also include a key ring and a bottle/can opener to provide various functions in a single tool.

16 Claims, 2 Drawing Sheets

(56) References Cited

U.S. PATENT DOCUMENTS

| | | | | |
|---|---|---|---|---|
| 9,475,197 | B1 * | 10/2016 | McAuley | B25B 9/02 |
| 9,880,647 | B2 * | 1/2018 | Askew | G06F 1/163 |
| 2008/0173134 | A1 * | 7/2008 | Lawson | B67B 7/403 81/3.09 |
| 2009/0151513 | A1 * | 6/2009 | Gross | B67B 7/18 81/3.55 |
| 2009/0158899 | A1 * | 6/2009 | Eisenbraun | A45F 5/02 24/599.1 |
| 2017/0355583 | A1 * | 12/2017 | Kelly | B67B 7/16 |
| 2018/0186616 | A1 * | 7/2018 | Lippert | B67B 7/16 |

* cited by examiner

MULTI-FUNCTION NAIL TOOL

BACKGROUND

In many instances, gripping and manipulating objects in an environment may be difficult for various individuals. For example, inserting and removing a card into a card reader can be difficult for various individuals. Particularly, individuals with accessories on their fingers (e.g., long fingernails, acrylic nails) or individuals with various ailments may have difficult performing various tasks.

DETAILED DESCRIPTION

The present embodiments relate to a multi-function nail tool. The tool can include various features, such as a gripping tool, a key ring, and/or a bottle/can opener. The gripping tool can allow for gripping and manipulating objects with ease.

For example, an individual may have difficulty inserting a credit card into a credit card reader. In this example, the gripping tools included in the multi-function nail tool can grip the credit card and allow for easy manipulation of the credit card (e.g., insertion of the credit card into the credit card reader). Particularly, when the individual has specific nail features (e.g., long fingernails, acrylic fingernails), the individual can easily grip items using the multi-function tool. This can increase user experience.

Further, the multi-function nail tool can include a key ring for easy connection to other objects (e.g., a set of keys) for the individual. Additionally, the multi-function nail tool can include a bottle/can opener to allow for opening of objects, such as a bottle or can.

The multi-function nail tool can provide multiple functions in a single device. Accordingly, rather than requiring multiple separate devices to perform tasks, the multi-function nail tool as described herein can perform various functions.

Figure 1:
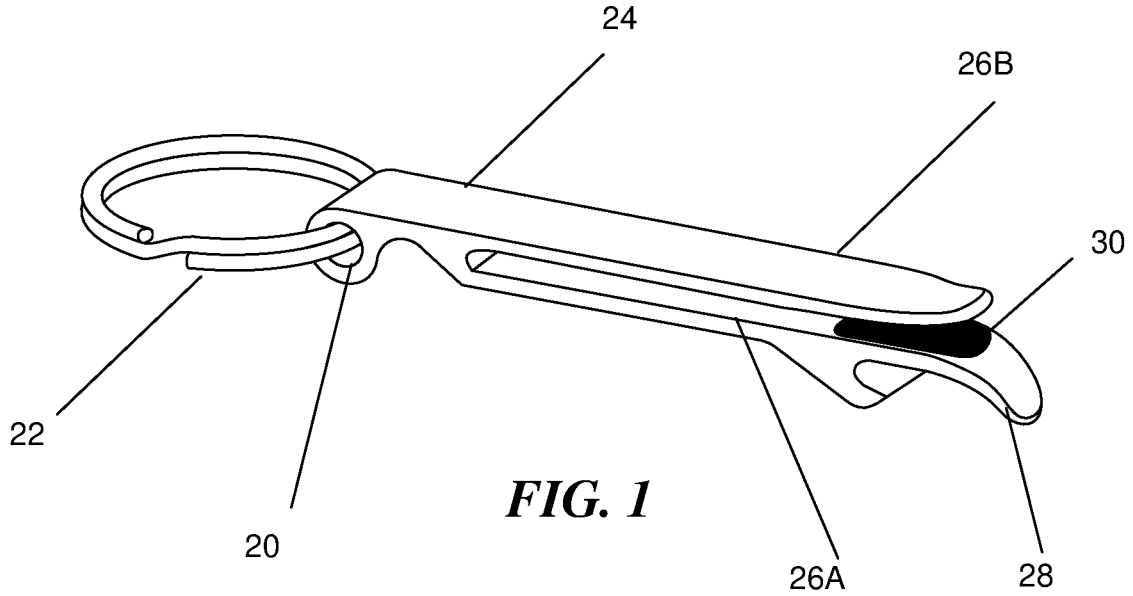
FIG. 1 is a first perspective view of an example multi-function nail tool.

FIG. 1 is a first perspective view of an example multi-function nail tool. As shown in FIG. 1, the tool can include a first end that includes a loop 20. The loop 20 at the first end can receive the key ring 22. Extending from the first end 24 can include two extension arms or gripping tongs 26A, 26B. The two extension arms can bend/flex so as to allow for gripping of objects. A first extension arm 26A can be disposed below the second extension arm 26B. The first gripping tong 26A further acts as a bottle opener with a clawed end 28. Other configurations of known bottle openers may be implemented as well.

The first extension arm 26A can include a curved end that curves downward away from the second extension arm 26B. The clawed end 28 may be further described as a fin extending downward away from the first extension arm 26A. The curved end and the fin of the first extension arm 26A can comprise the bottle/can opener as described herein.

In some embodiments, the clawed end 28 is sharpened to a point at the end. Depending on the fineness and angle of the point, the sharpened claw end forms a nail cleaner or a can punch opener.

A gripping material (e.g., rubber or another suitable material) 30 can be disposed on a portion of an interior surface of the two extension arms 26A, 26B. The gripping material can assist with gripping to objects.

Figure 2:
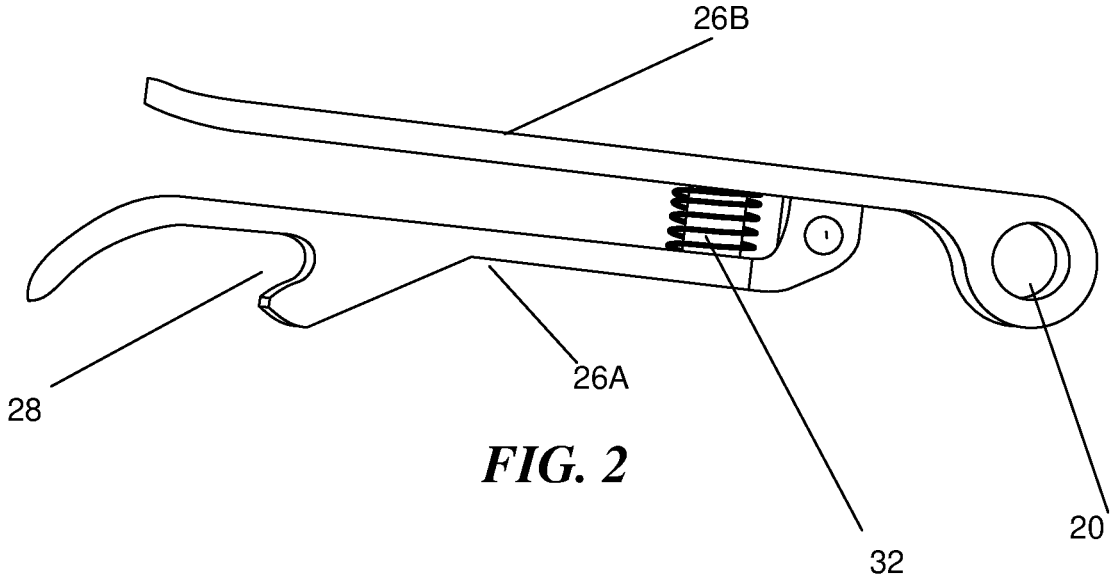
FIG. 2 is a second perspective view of an example multi-function nail tool.

FIG. 2 is a second perspective view of an example multi-function nail tool. As shown in FIG. 2, the tool can incorporate a spring 32. The spring 32 can be disposed between the two extension arms 26A, 26B and allow for greater flexibility and control of the extension arms 26A, 26B.

Figure 3:
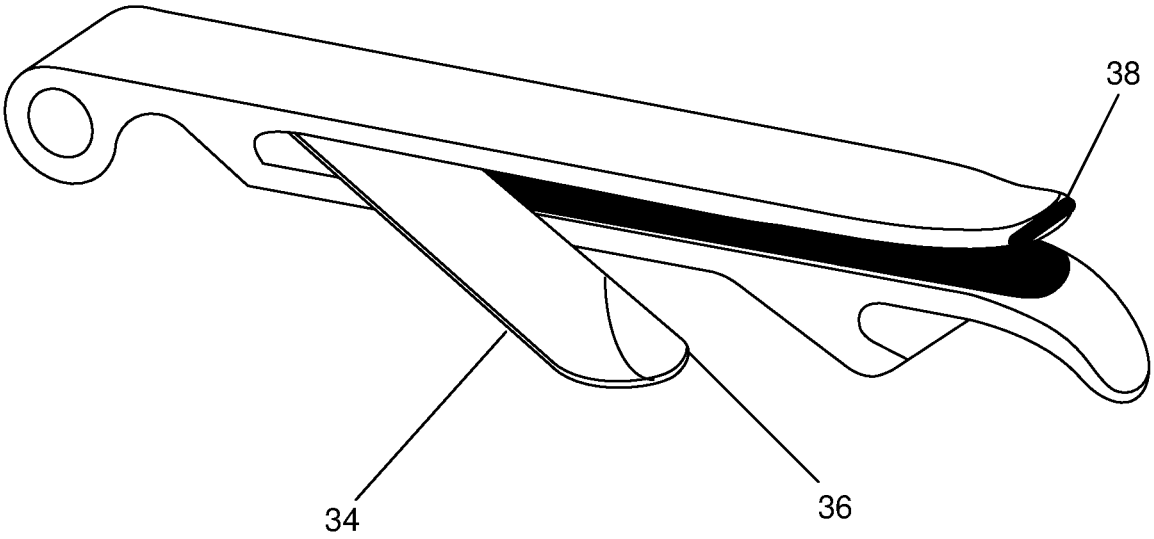
FIG. 3 is a third perspective view of an example multi-function nail tool.

FIG. 3 is a third perspective view of an example multi-function nail tool. As shown in FIG. 3, an intermediary arm 34 can extend from the first end and move relative to a horizontal axis. The intermediary arm 34 can allow for particular functionality, such as picking up coins from the ground. The intermediary arm 34 may include a scooper 36 at the end. The scooper 36 is a region at the extended tip of the intermediary arm 34 that is thinner than surrounding regions. The thinner section more easily slides under objects to enable scooping.

In some embodiments, the bottom side of the intermediary arm 34 is patterned or shaped roughly to act as a nail file. The nail filing region starts as a square on the bottom side of the intermediary arm 34 and extends up to the entire arm.

In some embodiments, the rubber gripping material can include a conductive rubber tip 38. The conductive rubber tip 38 can allow for the user to operate a touchscreen of an electronic device, for example.

CONCLUSION

Unless contrary to physical possibility, it is envisioned that (i) the methods/steps described above may be performed in any sequence and/or in any combination, and that (ii) the components of respective embodiments may be combined in any manner.

Any of the steps as described in any methods or flow processes herein can be performed in any order to the extent the steps in the methods or flow processes remain logical.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described but can be practiced with modification and alteration within the spirit and scope of the appended claims. Accordingly, the specification and drawings are to be regarded in an illustrative sense rather than a restrictive sense.

The invention claimed is:

1. A keychain tool comprising:

a keyring in a shape of a split ring;

a bottle opener configured to apply vertical leverage, the bottle opener including:

a flat elongated portion;

a curved end; and a clawed end extending from the flat elongated portion; and gripping tongs including a first gripping tong and a second gripping tong, wherein at least a part of the flat elongated portion of the bottle opener forms the first gripping tong, and wherein the gripping tongs include a spring positioned at a conjoining end of the gripping tongs.

2. The keychain tool of claim 1, wherein the gripping tongs include an interior high friction liner.

3. The keychain tool of claim 1, wherein the gripping tongs further include an intermediary arm that extends from the conjoining end of the gripping tongs and rotates around the conjoining end.

4. The keychain tool of claim 3, wherein the intermediary arm includes a scoop.

5. The keychain tool of claim 1, wherein an end of the gripping tongs include a conductive rubber tip that is configured to interact with touchscreens.

6. A keychain tool comprising:

a keyring in a shape of a split ring;

a bottle opener configured to apply vertical leverage, the bottle opener including:

a flat elongated portion;

a curved end; and a clawed end extending from the flat elongated portion; and gripping tongs including a first gripping tong and a second gripping tong, wherein at least a part of the flat elongated portion of the bottle opener forms the first gripping tong, wherein the gripping tongs include an intermediary arm that extends from a conjoining end of the gripping tongs and rotates around the conjoining end, and wherein the intermediary arm includes a scoop.

7. The keychain tool of claim 6, wherein the gripping tongs include an interior high friction liner.

8. The keychain tool of claim 6, wherein the gripping tongs include a spring positioned at the conjoining end of the gripping tongs.

9. The keychain tool of claim 6, wherein one end of the gripping tongs includes conductive rubber tips that are configured to interact with touchscreens.

10. A keychain bottle opener having a flat elongated portion with a curved end and a clawed end, the improvement comprising:

a gripping tong positioned parallel with the flat elongated portion of the bottle opener and physically conjoined with the flat elongated portion on an end opposite the curved end, wherein a tip of the gripping tong is configured to apply a gripping force via a pincer action between the parallel positioned gripping tong and the flat elongated portion, and wherein the tip of the gripping tong includes a conductive rubber tip.

11. The keychain bottle opener of claim 10, wherein the gripping tong includes an interior high friction liner.

12. The keychain bottle opener of claim 10, wherein the improvement further comprises a spring positioned at a conjoining end of the gripping tong and the flat elongated portion of the bottle opener.

13. The keychain bottle opener of claim 10, wherein the gripping tong further includes an intermediary arm that extends from a conjoining end of the gripping tong and the flat elongated portion of the bottle opener and rotates around the conjoining end.

14. The keychain bottle opener of claim 13, wherein the intermediary arm includes a scoop.

15. The keychain bottle opener of claim 13, wherein bottom side of the intermediary arm includes an abrasive portion configured for nail filing.

16. The keychain bottle opener of claim 10, wherein the clawed end is fashioned to a point.

* * * * *